US006397408B1

(12) United States Patent
Veloskey et al.

(10) Patent No.: US 6,397,408 B1
(45) Date of Patent: Jun. 4, 2002

(54) RAMPED CAP UNIT FOR A MAIN POOL DRAIN COVER PLATE

(75) Inventors: Thomas E. Veloskey, San Marcos; Jeffrey A. Wichmann, Cardiff, both of CA (US)

(73) Assignee: Polaris Pool Systems, Inc., Vista, CA (US)

( * ) Notice: Subject to any disclaimer, the term of this patent is extended or adjusted under 35 U.S.C. 154(b) by 0 days.

(21) Appl. No.: 09/617,153

(22) Filed: Jul. 17, 2000

Related U.S. Application Data

(60) Provisional application No. 60/146,295, filed on Jul. 29, 1999.

(51) Int. Cl.[7] ..... E04H 4/12

(52) U.S. Cl. ..... 4/504; 4/292; 4/507

(58) Field of Search ..... 4/289, 292, 504, 4/507, 509; 210/163, 166, 416.2

(56) References Cited

U.S. PATENT DOCUMENTS 3,378,858 A * 4/1968 Jacuzzi ..... 4/507 X
4,115,878 A * 9/1978 Johnson et al. ..... 4/509 X
4,170,047 A * 10/1979 Corsette et al. ..... 4/292 X
4,658,449 A * 4/1987 Martin ..... 4/504 X
5,408,706 A * 4/1995 Barnes ..... 4/507

* cited by examiner

*Primary Examiner*—Robert M. Fetsuga
(74) *Attorney, Agent, or Firm*—Kelly Bauersfeld; Lowry & Kelley, LLP

(57) ABSTRACT

A ramped cap unit is provided for installation into a swimming pool in a position covering a main pool drain equipped with an upstanding antivortex safety drain cover plate, wherein the ramped cap unit has a smoothly contoured shape to permit a pool cleaner device to travel thereover without interrupting or obstructing cleaning operation. The cap unit comprises a generally inverted saucer defining a smoothly sloping and convex or ramped upwardly presented surface having a diametric size and shape to fit over the safety drain cover plate. An array of ribs formed on the underside of the cap unit engage an outer periphery of the upstanding cover plate to retain the cap unit in position thereon. A large plurality of vents are formed in the cap unit at spaced-apart locations to permit downward water flow therethrough substantially without disrupting the antivortex and safety functions of the underlying drain cover plate. The ramped upper surface of the cap unit permits a pool cleaner device to climb directly over the cap unit in the course of pool cleaner travel over submerged pool surfaces to collect and dislodge particulate debris settled thereon.

16 Claims, 8 Drawing Sheets

RAMPED CAP UNIT FOR A MAIN POOL DRAIN COVER PLATE

RELATED APPLICATION

This application claims the benefit of provisional application No. 60/146,295, filed Jul. 29, 1999.

BACKGROUND OF THE INVENTION

This invention relates generally to a ramped cap unit for use in combination with an antivortex or safety cover plate of the type installed over a main suction drain of a swimming pool or the like, wherein the ramped cap unit permits a pool cleaner device to travel directly over the ramped cap unit and the underlying safety drain cover plate without interrupting pool cleaning operation, and further without disrupting the antivortex and safety functions of the underlying safety cover plate.

Pool cleaner systems and related devices are generally well known in the art for use in maintaining residential and commercial swimming pools in a clean and attractive condition. In this regard, swimming pools conventionally include a water filtration system equipped with a pump for drawing or suctioning water from the pool for circulation through a filter canister having filter media therein to remove and collect water-entrained debris such as leaves and twigs as well as fine particulate including sand and silt. In a typical arrangement, at least a portion of the pool water is vacuum-drawn over a weir mounted within a so-called skimmer well positioned substantially at the water surface to draw and collect floating debris to the filter equipment, while another portion of the pool water is vacuum-drawn to the filter equipment through at least one so-called main suction drain located in the pool floor typically at a deep end thereof. From the filter canister, the water is recirculated to the pool via one or more return lines. Such filtration equipment is normally operated for several hours on a daily basis and serves, in combination with traditional chemical treatments such as chlorination or the like, to maintain the pool water in a clean and clear sanitary state.

The water filtration system is generally ineffective, however, to filter out debris which settles onto submerged floor and side wall surfaces of the swimming pool. In the past, settled debris has typically been removed by coupling a vacuum hose to the suction side of the pool water filtration system, such as by connecting the vacuum hose to the skimmer well located near the water surface at one side of the pool, and then manually moving a vacuum head coupled to the hose over the submerged pool surfaces to vacuum settled debris directly to the filter canister where it is collected and separated from the pool water. However, manual vacuuming of a swimming pool is a labor intensive task and is thus not typically performed by the pool owner or pool cleaning service personnel on a daily basis.

So-called automatic pool cleaner devices have been developed over the years for cleaning submerged pool surfaces, thereby substantially eliminating the need for labor intensive manual vacuuming. Such automatic pool cleaners typically comprise a relatively compact cleaner housing or head coupled to the pool water filtration system by a hose and including water-powered means for causing the cleaner to travel about preferably along a random path within a swimming pool to dislodge and collect settled debris. In one form, the pool cleaner is connected to the return or pressure side of the filtration system for receiving positive pressure water which powers a turbine for rotatably driving cleaner wheels, and also functions by venturi action to draw settled debris into a filter bag. See, for example, U.S. Pat Nos. 3,882,574; 4,558,479; 4,589,986; and 4,734,954. In another form, the pool cleaner is coupled by a vacuum hose to the suction side of the filtration system, whereby water is drawn through the pool cleaner to operate a drive mechanism for transporting the cleaner within the pool while vacuuming settled debris to the filter canister of the pool filtration system. See, for example, U.S. Pat. Nos. 3,803,658; 4,023,227; 4,133,068; 4,208,752; 4,643,217; 4,679,867; 4,729,406; 4,761,848; 5,105,496; 5,265,297; and 5,634,229. See also, copending U.S. Ser. No. 09/090,894, filed Jun. 4, 1998, and 09/176,532, filed Oct. 21, 1998.

In addition, in recent years, antivortex or safety cover plates have been developed for covering suction drains in a swimming pool or spa to reduce or eliminate the risk of suction-entrapment of a swimmer, particularly by suction-entrapment of a swimmer's hair or clothing. More specifically, the water filtration system pump is normally designed to draw water to the filtration equipment at a substantial flow rate and thus has the capacity to develop a significant suction or vacuum within filtration system flow lines. If a significant portion of the flow area of a suction drain is obstructed by a swimmer's hair or clothing or portion of the body while the filtration system is operating, the swimmer can be vacuum-drawn and retained at the drain with a substantial force to result in suction-entrapment of the swimmer and creating a risk of drowning. To safeguard against suction-entrapment accidents, many swimming pools are being constructed or retrofitted with an antivortex safety drain cover plate mounted over each pool suction drain and defining a geometric array of spaced-apart vents positioned to reduce or eliminate the risk of any significant portion of the vents being obstructed by a swimmer at one time.

Unfortunately, such safety drain cover plates typically project upwardly a short distance from the pool floor to define the multiple vents which may open in different directions, whereby the cover plate provides a raised obstruction to a pool cleaner as it traverses submerged pool surfaces to perform its desirable cleaning functions. In this regard, the pool cleaner can become trapped against the raised cover plate to interrupt normal cleaning operation.

The present invention relates to a relatively simple yet effective ramped cap unit for installation into a swimming pool in a position overlying an upstanding safety drain cover plate, wherein the cap unit is contoured to permit a pool cleaner to climb and travel directly thereover for uninterrupted cleaning operation, and further wherein the cap unit includes a large plurality of open flow vents to permit downward water flow therethrough substantially without disrupting the antivortex and safety functions of the underlying drain cover plate.

SUMMARY OF THE INVENTION

In accordance with the invention, a ramped cap unit is provided for installation into a swimming pool in a position covering a main pool drain equipped with an upstanding antivortex safety drain cover plate, wherein the ramped cap unit has a smoothly contoured shape to permit a pool cleaner device to travel thereover without interrupting or obstructing cleaning operation.

The ramped cap unit comprises a generally inverted saucer defining a smoothly sloping and convex or ramped upwardly presented surface having a diametric size and shape to fit over the safety drain cover plate. An array of ribs formed on the underside of the cap unit engage an outer periphery of the upstanding cover plate to retain the cap unit in position thereon, and to define a downwardly open central cavity into which the upstanding antivortex safety cover plate is nestably received. A large plurality of vents are formed in the cap unit at spaced-apart locations to permit downward water flow therethrough substantially without disrupting the antivortex and safety functions of the underlying drain cover plate. The ramped upper surface of the cap unit permits a pool cleaner device to climb directly over the cap unit in the course of pool cleaner travel over submerged pool surfaces to collect and dislodge particulate debris settled thereon.

In a preferred configuration, the ramped cap unit comprises a central disk having a size and shape corresponding generally with the size and shape of the safety cover plate. The central disk is assembled with an outer annular ring which may by formed from an assembled plurality of part-circle ring segments. Each ring segment has a plurality of vents formed therein to permit downward water flow therethrough to the underside of the annular ring into a plenum chamber in flow communication with vents formed in the safety cover plate. The annular ring tapers radially outwardly and downwardly from the central disk to an outer perimeter disposed substantially flush with the pool floor.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
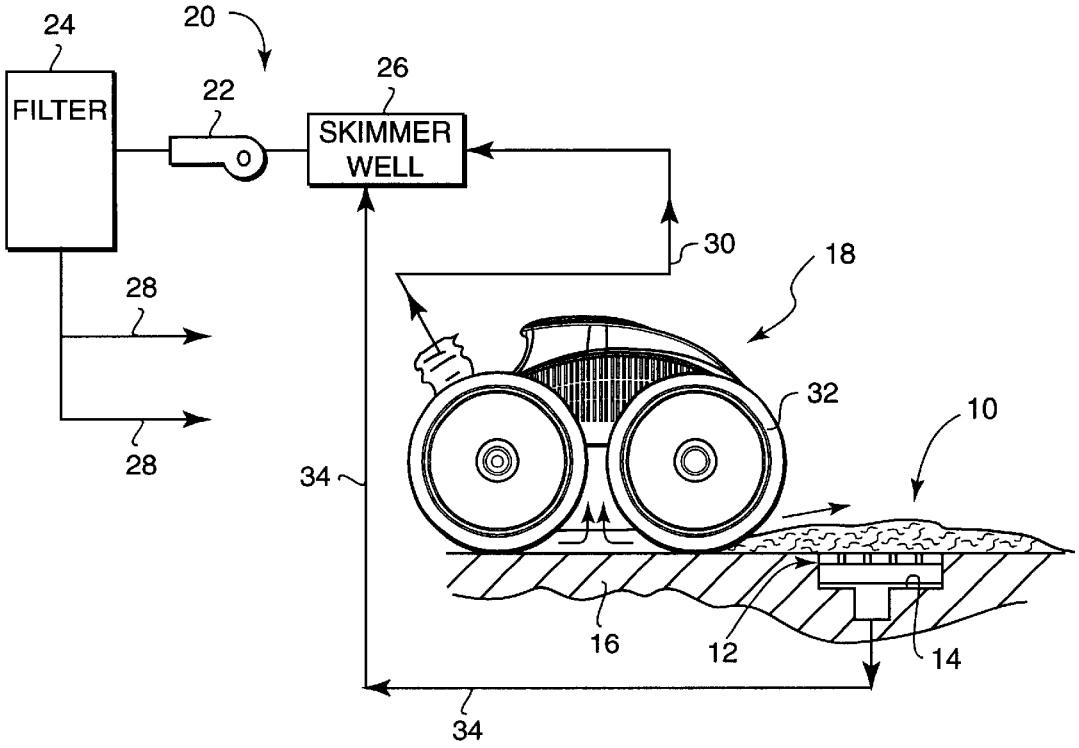
FIG. 1 is a schematic representation of a swimming pool filtration system in combination with a suction-powered pool cleaner for cleaning submerged pool floor and side wall surfaces, and further illustrating the pool cleaner traversing a ramped cap unit embodying the novel features of the invention.

As shown in the exemplary drawings, a ramped cap unit referred to generally in FIGS. 1–8 by the reference numeral 10 is provided for mounting over an antivortex safety drain cover plate 12 which is mounted in turn over a main suction 14 drain located in a floor 16 of a swimming pool or the like as viewed in FIG. 1. The ramped cap unit 10 is designed to provide a smoothly contoured profile shape to permit uninterrupted travel of a pool cleaner 18 over submerged pool surfaces to dislodge and collect particulate and debris settled thereon. In addition, the cap unit 10 is designed for compatibility with the safety cover plate 12, to avoid disrupting the desired function of the safety cover plate in reducing or eliminating risk of suction-entrapment of any portion of a swimmer's body or clothing at the main drain 14, As schematically illustrated in FIG. 1, the swimming pool includes a conventional water filtration and cleaning system 20 to include a pump 22 for drawing water from the swimming pool for passage through a filter canister 24 having a selected filtration media (not shown) contained therein for capturing and collecting silt and grit and other particulate debris matter entrained in the water flow stream. The pump 22 draws a portion of the pool water through a skimmer well 26 which is normally mounted at one edge of the pool generally at the water's surface and includes a weir (not shown) over which water is drawn to skim and collect debris floating on the surface of the pool water. In addition, the pump 22 draws another portion of the pool water through at least one main pool drain 14 located in the pool floor 16 typically at a deep end of the swimming pool. The filtered water is recirculated from the filter canister 24 to the swimming pool through one or more return conduits 28.

The pool cleaner 18 is coupled by a flexible hose 30 to the filtration system 20 and is adapted to be driven hydraulically to traverse submerged pool floor and side wall surfaces preferably in a random pattern to pick up and collect debris such as leaves and twigs as well as small particulate such as sand and silt settled thereon. The illustrative pool cleaner 18 is suction-powered by connecting the hose 30 to the suction side of the filtration system pump 22, as by hose connection to the skimmer well 26, wherein internal drive means (not shown) is hydraulically driven for rotatably driving one or more traction drive wheels 32 to transport the pool cleaner over submerged pool surfaces while additionally providing a suction cleaning flow to pick up settled dirt and debris for flow to the filter canister 24. Alternately, it will be recognized and understood that other pool cleaners may be used of the type driven by a positive pressure water flow at the discharge side of the pump 22. Exemplary suction-powered pool cleaners are shown and described in U.S. Pat. Nos. 3,803,658; 4,023,227; 4,133,068; 4,208,752; 4,643,217; 4,679,867; 4,729,406; 4,761,848; 5,105,496; 5,265,297; 5,634,229; and also in copending U.S. Ser. No. 09/090,894, filed Jun. 4, 1998, and Ser. No. 09/176,532, filed Oct. 21, 1998, all of which are incorporated by reference herein. Exemplary pressure-powered pool cleaners are shown and described in U.S. Pat. Nos. 3,882,574; 4,558,479; 4,589,986; and 4,734,954, which are incorporated by reference herein.

Figure 2:
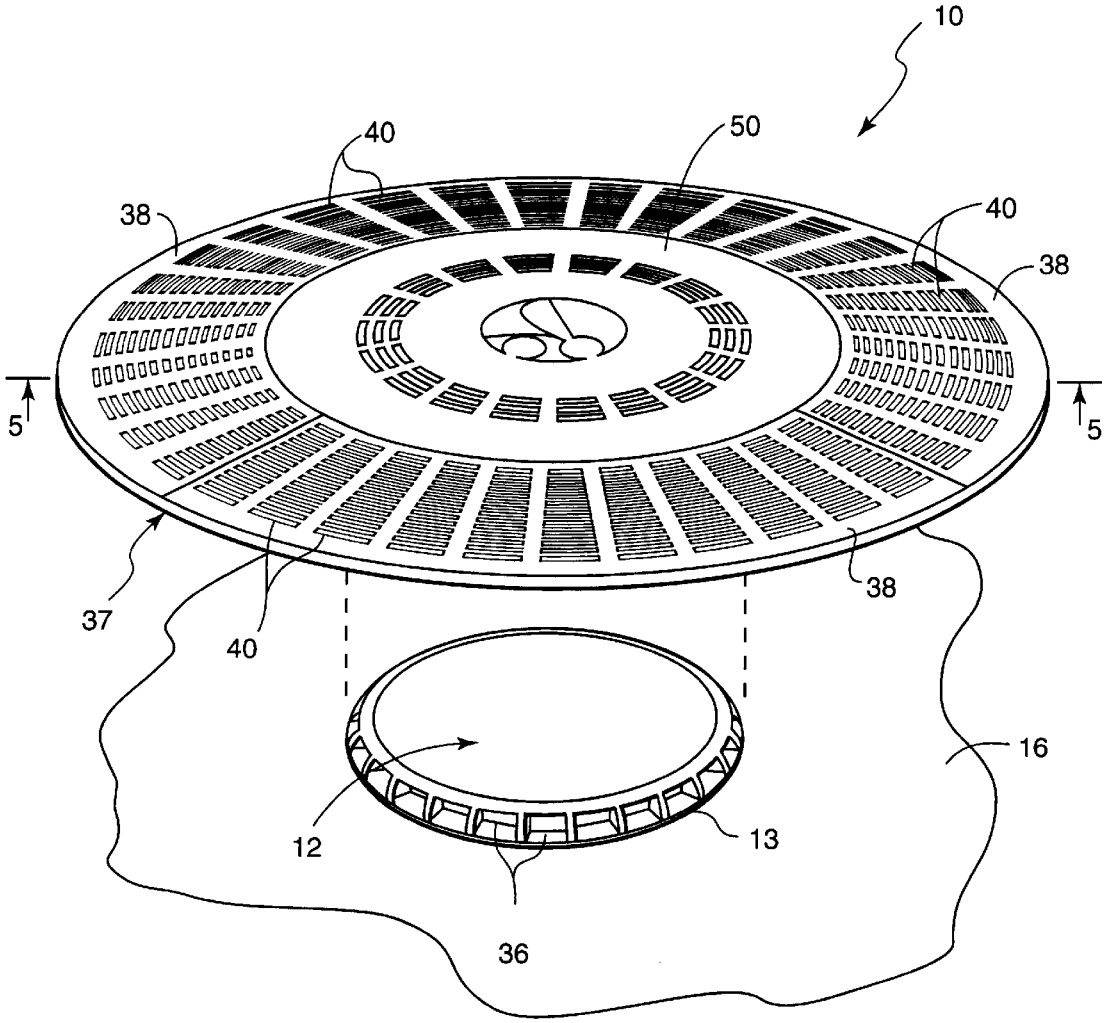
FIG. 2 is an exploded top perspective view showing the ramped cap unit for installation over an antivortex safety cover plate which is mounted in turn over a main pool drain.
Figure 3:
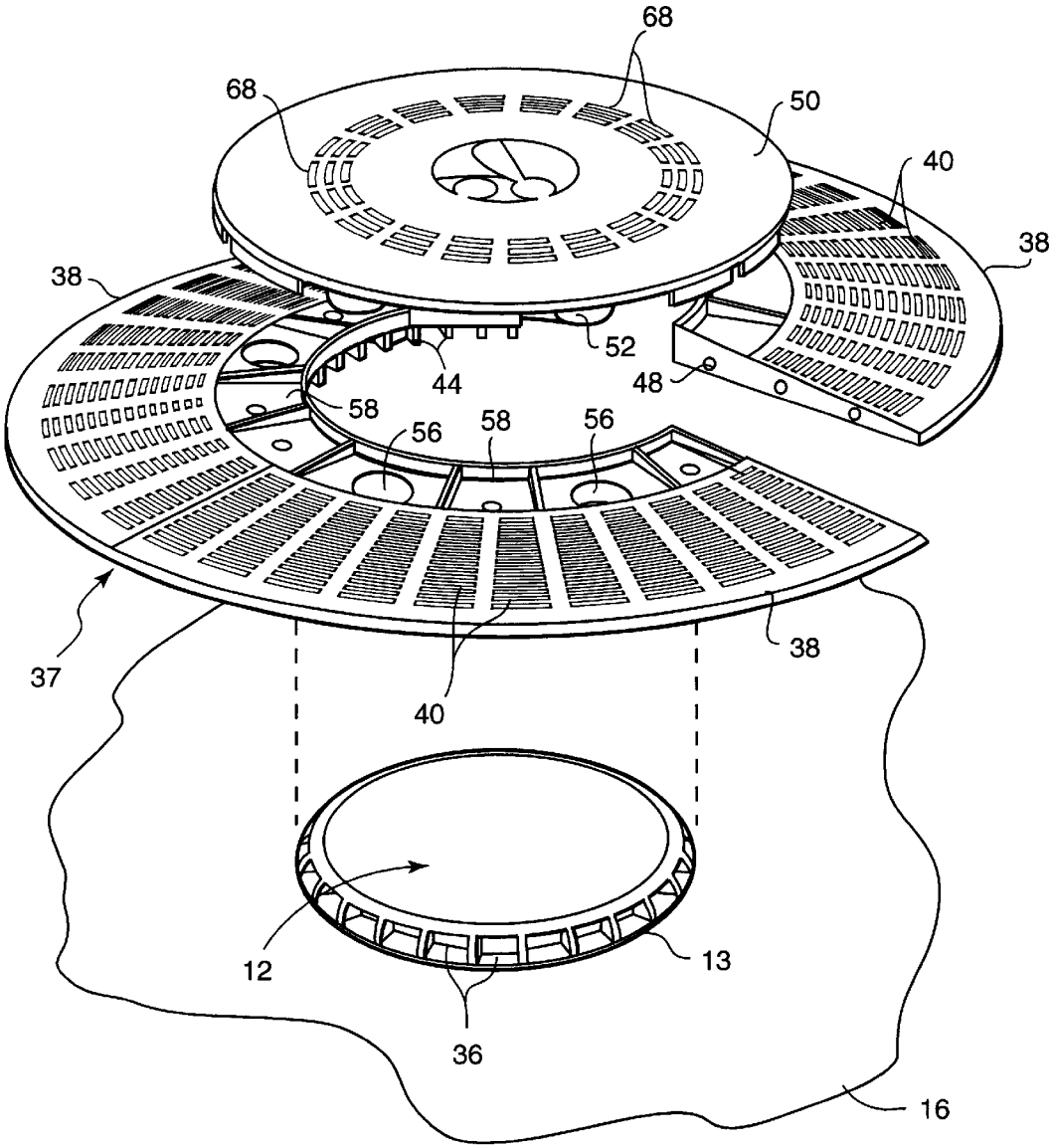
FIG. 3 is an exploded top perspective view similar to FIG. 2, illustrating assembly of cap unit components.
Figure 4:
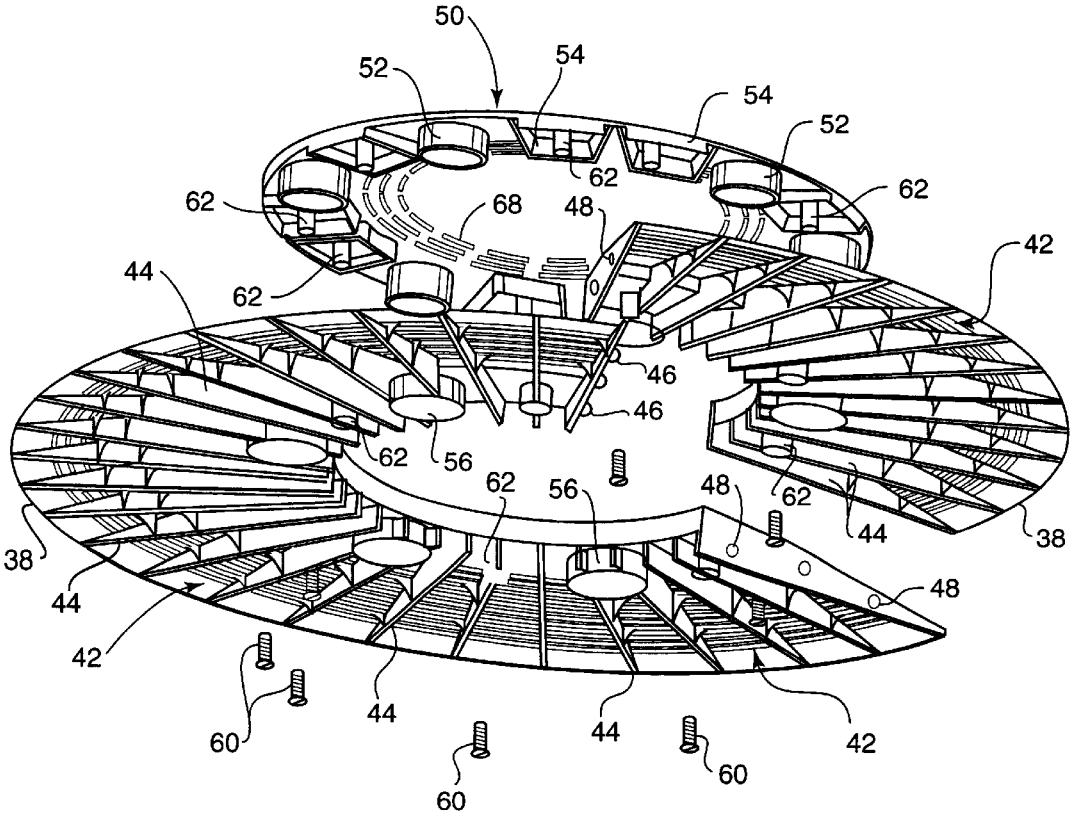
FIG. 4 is an exploded bottom perspective view illustrating assembly of cap unit components.
Figure 5:
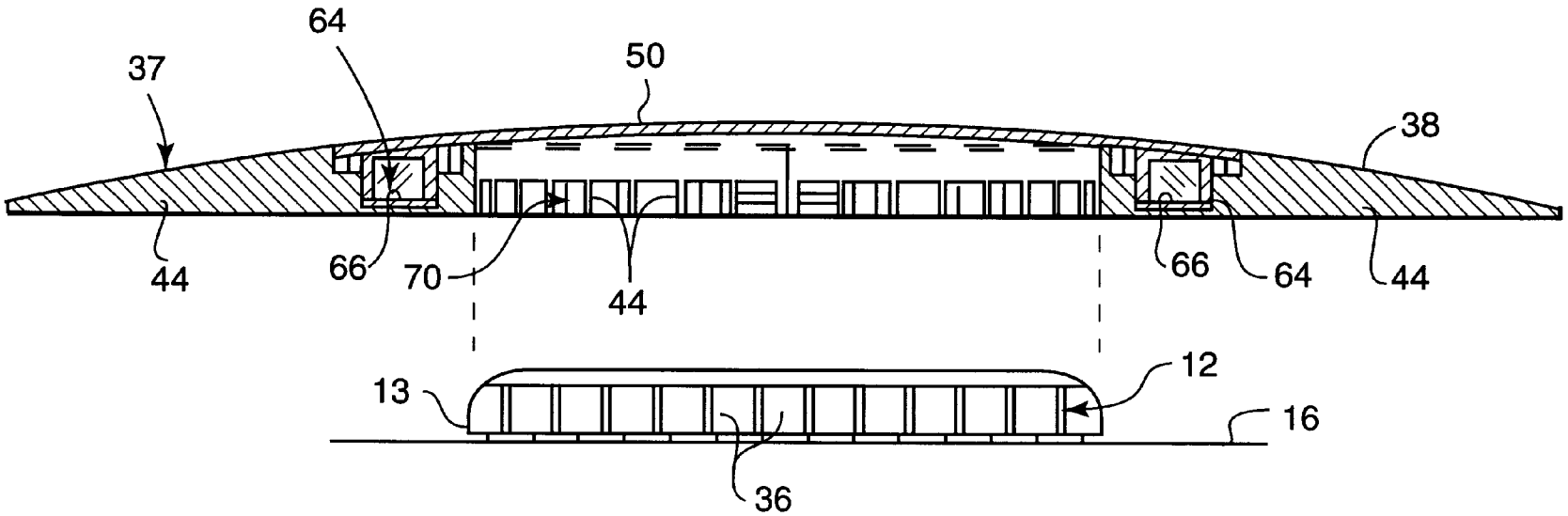
FIG. 5 is a longitudinal vertical sectional view taken generally on the line 5—5 of FIG. 2, and depicted in exploded relation with an underlying safety cover plate mounted over a main pool drain.

The ramped cap unit 10 comprises an enlarged and generally inverted saucer-shaped disk structure or saucer having a size and shape to rest on the pool floor 16 in a position overlying the safety cover plate 12 at the main drain 14. In this regard, as shown best in FIGS. 1–3, the main drain 14 conventionally comprises an upwardly open passage formed in the pool floor 16 (FIG. 1) for suction flow of water from the pool to the filtration equipment 20 via appropriate flow lines 34, as previously described. This drain passage 14 is covered by the antivortex safety drain cover plate 12 which upstands a short distance from the pool floor 16 and defines a plurality of open vents 36 arranged in a geometric pattern to reduce or eliminate risk of substantial obstruction of a significant portion of the open flow area at any one time by a swimmer, to correspondingly reduce or eliminate risk of swimmer suction-entrapment. FIGS. 2–3 and 5 show the safety cover plate 12 upstanding from the pool floor 16, wherein a peripheral outer rim 13 of the cover plate is elevated a short distance above the pool floor 16 (FIG. 5) to permit water flow through the array of vents 36 shown arranged circumferentially about said rim 13 to the main drain 14. The upstanding safety cover plate 12 presents an obstruction to the pool cleaner 18 to potentially interrupt or stall pool cleaner travel throughout the pool to perform its desired cleaning functions.

The ramped cap unit 10 generally comprises an outer annular ring 37 formed from a plurality of part-circle ring segments 38, three of which are shown in the illustrative drawings. These ring segments 38 are conveniently constructed from molded plastic each to include a large plurality of upwardly open vents 40 to accommodate downward water flow from above the cap unit 10 into an underlying plenum chamber 42 at the underside thereof. As shown best in FIG. 4, this plenum chamber 42 is subdivided by a plurality of circumferentially spaced, radially extending ribs 44 depending from the ring segments 38. These ribs 44 extend radially outwardly from an inner peripheral margin of the annular ring 37 with progressively decreasing height and terminate at an outer peripheral margin thereof so that said outer peripheral margin of the annular ring 37 rests substantially flush on the pool floor 16. Importantly, each ring segment 38 includes laterally projecting snap pins 46 at one side thereof, and laterally open snap ports 48 at an opposite side thereof, whereby the ring segments 38 can be snap-fit assembled to construct the annular ring 37.

The cap unit 10 additionally includes a central disk 50 mounted on the outer ring 37 to extend over and close the region bounded by the inner peripheral margin of the ring 37. This central disk 50 is also formed conveniently and economically from molded plastic or the like, and has a plurality of short protrusions 52 and 54 (shown best in FIG. 4) extending downwardly from the periphery thereof for mated and slide-fit reception into matingly shaped sockets 56 and 58 formed in an upper face of the ring segments 38 at the inner periphery thereof of the annular ring 37. In the preferred form as shown, the protrusions 52 are round in shape for mating reception into round sockets 56, whereas the protrusions 54 are square or rectangular in shape for mating reception into similarly shaped sockets 58. Mounting screws 60 are desirably passed through selected ring sockets 58 and are fastened into mounting posts 62 on the underside of the central disk 50 to securely interconnect and assemble the outer ring 37 with the disk 50. In addition, ballast weights 64 (FIG. 5) may be encased within small pockets 66 defined by the interfitting protrusions 52 and sockets 56, to assist in retaining the assembled cap unit 10 on the pool floor 14 is a position substantially centered over the drain cover plate 12. A series of vents 68 may also be provided in the central disk 50 to permit water flow downwardly to the underlying pool drain 14. Alternately, in lieu of or in addition to the ballast weights 64, the plastic material used for the ring segments 38 and/or the central disk 50 may be filled so that these components are relatively heavy and will thus remain seated on the pool floor over the drain cover plate 12.

The diametric size of the assembled cap unit 10 is significantly greater than the diametric size of the underlying safety drain cover plate 12 mounted over the main pool drain 14. When the cap unit 10 is placed in a substantially centered position over the main drain 14 and the associated upstanding cover plate 12, the cover plate 12 fits into a downwardly open central cavity 70 (FIG. 5) defined cooperatively by the central disk 50 and the radially inner ends of the ribs 44 on the ring segments 38. In this regard, the inner ends of these ribs 44 circumferentially surround the outer peripheral rim 13 of the cover plate 12 and thus are positioned to engage said outer rim 13 to prevent significant lateral shifting displacement of the cap unit 10 relative 20 to the upstanding cover plate 12. Importantly, the large number of spaced-apart vents 40 formed in the ring segments 38 permit substantial downward water flow through the cap unit 10 to the vents 36 formed in the underlying safety cover plate 12 to avoid disrupting or interfering with the antivortex safety function thereof.

Figure 6:
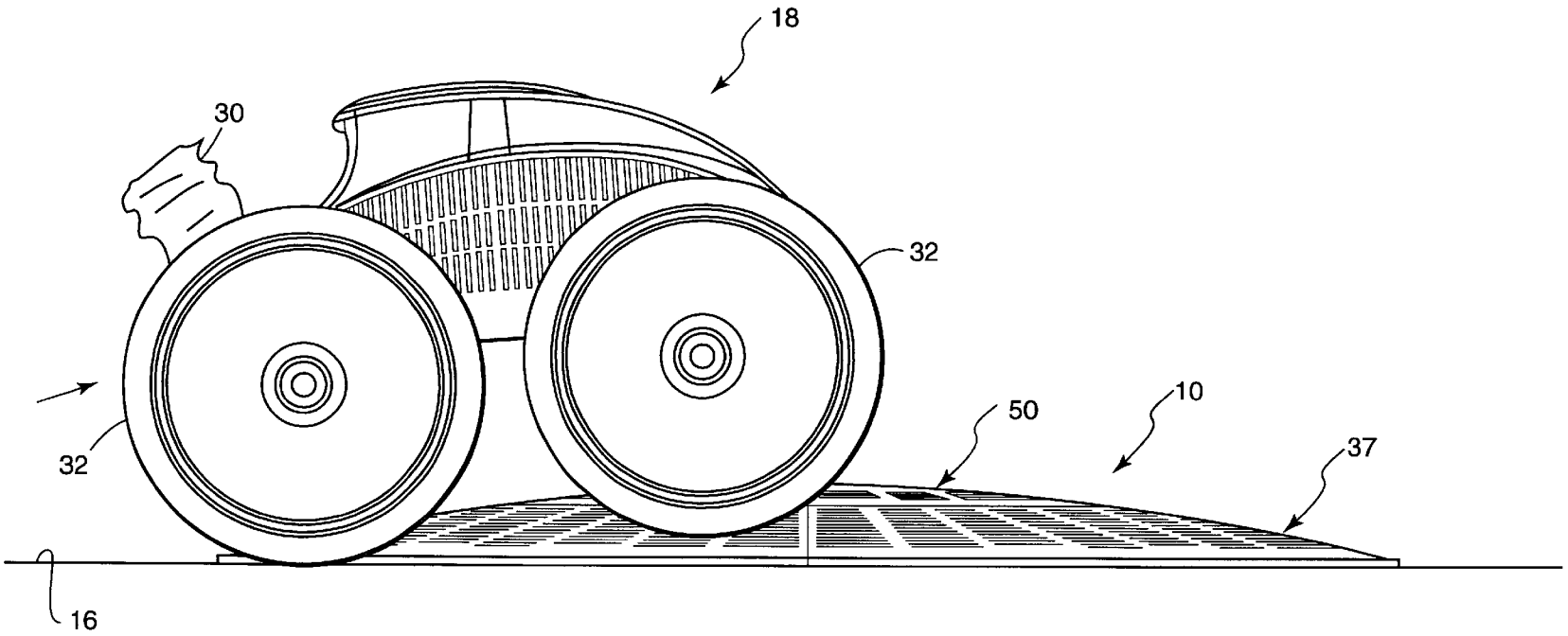
FIG. 6 is a fragmented side elevational view depicting a pool cleaner in a position climbing onto the ramped cap unit.
Figure 7:
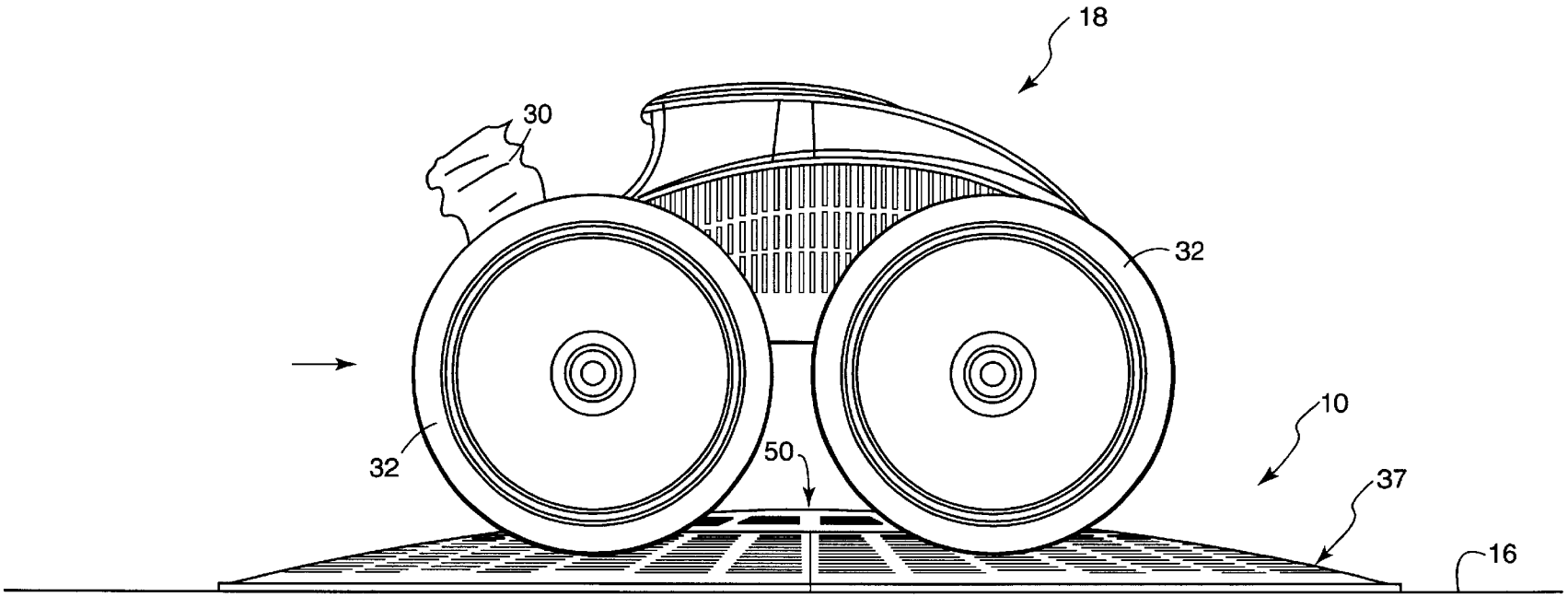
FIG. 7 is a fragmented side elevational view similar to FIG. 6, but showing the pool cleaner in a substantially centered position on top of the cap unit.
Figure 8:
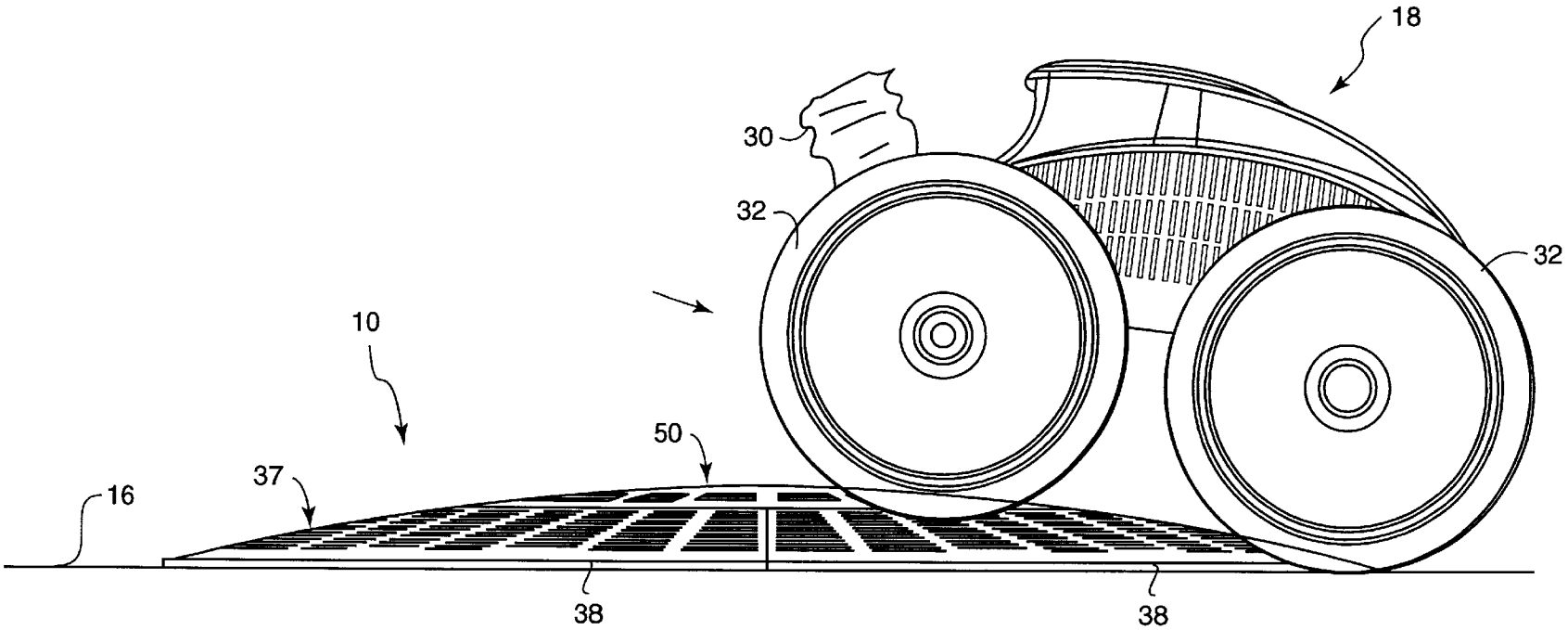
FIG. 8 is a fragmented side elevational view similar to FIGS. 6 and 7, but showing the pool cleaner in a position descending from the cap unit.

The geometric profile of the cap unit 10 permits unobstructed travel of the pool cleaner 18 throughout the swimming pool to perform its desired cleaning functions. In this regard, as shown best in FIGS. 1 and 6–8, the outer peripheral margin of the cap unit 10 rests substantially flush on the pool floor 16 so as not to present any significant upstanding peripheral ridge or step which might otherwise obstruct cleaner travel. Moreover, the tapered height ribs 44 on underside of the ring segments 38 support the annular ring 37 in a manner defining an upwardly presented surface having a gentle incline relative to the pool floor 16, wherein this incline forms a tapered ramp leading to the central disk 50. This geometry enables the pool cleaner 18 to climb directly and easily onto and over the cap unit 10, as shown in FIGS. 6–8, when the pool cleaner path of motion is intercepted by the cap unit. FIG. 6 shows the pool cleaner 18 initially climbing onto the cap unit 10, whereas FIG. 7 shows the pool cleaner 18 is a position directly on top of the cap unit. Finally, FIG. 8 illustrates the pool cleaner as it travels down the ramped cap unit to travel back onto the pool floor 16.

A variety of modifications and improvements in and to the ramped cap unit 10 of the present invention will be apparent to those persons skilled in the art. Accordingly, no limitation on the invention is intended by way of the foregoing description and accompanying drawings, except at set forth in the appended claims.

What is claimed is:

1. A ramped cap unit for use in a swimming pool to fit over a safety cover plate mounted over a pool drain formed in a submerged pool surface, wherein the safety cover plate upstands from the submerged pool surface, said ramped cap unit comprising:

a generally inverted saucer having a central disk with a size and shape to fit over the safety cover plate, said central disk being assembled with a generally annular outer ring extending radially outwardly and downwardly from said central disk to define an outer perimeter adapted to rest substantially flush on the submerged pool surface when said central disk is fitted over the safety cover plate, said outer ring comprising a plurality of part-circle ring segments assembled together;

said saucer being shaped to define a plenum chamber at an underside thereof in flow communication with the safety cover plate;

said saucer having a plurality of vents formed therein to permit downward water flow from above said saucer to said plenum chamber;

said saucer having a smoothly sloping upwardly presented surface to permit substantially uninterrupted travel of a pool cleaner thereover.

2. The ramped cap unit of claim 1 wherein said ring segments include snap-fit means for retaining said ring segments in assembled relation.

3. The ramped cap unit of claim 1 wherein said plurality of vents are formed in said outer ring.

4. The ramped cap unit of claim 3 further including an additional plurality of vents formed in said central disk.

5. The ramped cap unit of claim 1 wherein said central disk and said outer ring cooperatively define a downwardly open cavity for substantially nested reception of the safety cover plate.

6. The ramped cap unit of claim 1 wherein said outer ring includes a plurality of downwardly extending and generally radially elongated support ribs each having a height decreasing in a radially outwardly direction, said support ribs being adapted to contact the submerged pool surface for spacing at least a portion of said outer ring from said submerged pool surface to define said plenum chamber.

7. A ramped cap unit for use in a swimming pool to fit over a safety cover plate mounted over a pool drain formed in a submerged pool surface, wherein the safety cover plate upstands from the submerged pool surface, said ramped cap unit comprising:

a generally inverted saucer having a central disk with a size and shape to fit over the safety cover plate and a generally annular outer ring extending radially outwardly and downwardly from said central disk to define an outer perimeter adapted to rest substantially flush on the submerged pool surface when said central disk is fitted over the safety cover plate;

said saucer being shaped to define a plenum chamber at an underside thereof in flow communication with the safety cover plate;

said saucer having a plurality of vents formed therein to permit downward water flow from above said saucer to said plenum chamber;

said saucer having a smoothly sloping upwardly presented surface to permit substantially uninterrupted travel of a pool cleaner thereover; and further including ballast means carried by said saucer.

8. The ramped cap unit of claim 7 wherein said central disk and said outer ring include interfitting members cooperatively defining at least one hollow socket, and further wherein said ballast means comprises a weight carried within said socket.

9. A ramped cap unit for use in combination with an antivortex safety cover plate mounted over a drain opening formed in a floor of a swimming pool or the like, wherein the safety cover plate upstands from the pool floor, said ramped cap unit comprising:

a generally inverted saucer having a central disk with a size and shape to fit over the safety cover plate, said central disk being assembled with a generally annular outer ring extending radially outwardly and downwardly from said central disk to define an outer perimeter adapted to rest substantially flush on the submerged pool surface at a location spaced radially outwardly from the safety cover plate when said central disk is fitted thereover, said outer ring comprising a plurality of part-circle ring segments assembled together;

said outer ring being shaped to define a plenum chamber at an underside thereof and extending generally annularly about the safety cover plate in flow communication therewith;

said outer ring having a plurality of vents formed therein to permit downward water flow from thereabove to said plenum chamber;

said saucer having a smoothly sloping upwardly presented surface to permit substantially uninterrupted travel of a pool cleaner thereover.

10. The ramped cap unit of claim 9 wherein said ring segments include snap-fit means for retaining said ring segments in assembled relation.

11. The ramped cap unit of claim 9 further including a plurality of additional vents formed in said central disk.

12. The ramped cap unit of claim 9 wherein said central disk and said outer ring cooperatively define a downwardly open cavity for substantially nested reception of the safety cover plate.

13. The ramped cap unit of claim 9 wherein said outer ring includes a plurality of downwardly extending and generally radially elongated support ribs each having a height decreasing in a radially outwardly direction, said support ribs being adapted to contact the submerged pool surface for spacing at least a portion of said outer ring from said submerged pool surface to define said plenum chamber.

14. A ramped cap unit for use in combination with an antivortex safety cover plate mounted over a drain opening formed in a floor of a swimming pool or the like, wherein the safety cover plate upstands from the pool floor, said ramped cap unit comprising:

a generally inverted saucer having a central disk with a size and shape to fit over the safety cover plate and a generally annular outer ring extending radially outwardly and downwardly from said central disk to define an outer perimeter adapted to rest substantially flush on the submerged pool surface at a location spaced radially outwardly from the safety cover plate when said central disk is fitted thereover;

said outer ring being shaped to define a plenum chamber at an underside thereof and extending generally annularly about the safety cover plate in flow communication therewith;

said outer ring having a plurality of vents formed therein to permit downward water flow from thereabove to said plenum chamber;

said saucer having a smoothly sloping upwardly presented surface to permit substantially uninterrupted travel of a pool cleaner thereover;

said outer ring including a plurality of downwardly extending and generally radially elongated support ribs each having a height decreasing in a radially outwardly direction, said support ribs being adapted to contact the submerged pool surface for spacing at least a portion of said outer ring from said submerged pool surface to define said plenum chamber; and wherein said support ribs have radially inner ends cooperating with said central disk to define a downwardly open cavity for substantially nested reception of the safety cover plate.

15. A ramped cap unit for use in combination with an antivortex safety cover plate mounted over a drain opening formed in a floor of a swimming pool or the like, wherein the safety cover plate upstands from the pool floor, said ramped cap unit comprising:

a generally inverted saucer having a central disk with a size and shape to fit over the safety cover plate and a generally annular outer ring extending radially outwardly and downwardly from said central disk to define an outer perimeter adapted to rest substantially flush on the submerged pool surface at a location spaced radially outwardly from the safety cover plate when said central disk is fitted thereover;

said outer ring being shaped to define a plenum chamber at an underside thereof and extending generally annularly about the safety cover plate in flow communication therewith;

said outer ring having a plurality of vents formed therein to permit downward water flow from thereabove to said plenum chamber;

said saucer having a smoothly sloping upwardly presented surface to permit substantially uninterrupted travel of a pool cleaner thereover; and further including ballast means carried by said saucer.

16. The ramped cap unit of claim 15 wherein said central disk and said outer ring include interfitting members cooperatively defining at least one hollow socket, and further wherein said ballast means comprises a weight carried within said socket.

* * * * *